US005409556A

United States Patent [19]

Lownds

[11] Patent Number: 5,409,556

[45] Date of Patent: Apr. 25, 1995

[54] METHOD OF LOWERING THE DENSITY OF AMMONIUM NITRATE-BASED MINING EXPLOSIVES WITH EXPANDED AGRICULTURAL GRAIN SO THAT A DENSITY OF 0.3G/CC TO 1.0G/CC IS ACHIEVED

[75] Inventor: Charles M. Lownds, Salt Lake City, Utah

[73] Assignee: Mining Services International, Salt Lake City, Utah

[21] Appl. No.: 287,469

[22] Filed: Aug. 8, 1994

Related U.S. Application Data

[63] Continuation of Ser. No. 42,132, Apr. 2, 1993, abandoned.

[51] Int. Cl.[6] ..... C06B 45/00

[52] U.S. Cl. ..... 149/2; 149/60; 149/61

[58] Field of Search ..... 149/2, 46, 60, 61

[56] References Cited

U.S. PATENT DOCUMENTS

| | | | |
|---|---|---|---|
| 3,730,093 | 5/1973 | Cummings | 102/6 |
| 4,111,727 | 9/1978 | Clay | 149/2 |
| 4,181,546 | 1/1980 | Clay | 149/21 |
| 4,836,870 | 6/1989 | Cunningham et al. | 149/2 |

*Primary Examiner*—Donald P. Walsh
*Assistant Examiner*—Anthony R. Chi
*Attorney, Agent, or Firm*—Madson & Metcalf

[57] ABSTRACT

The density of ammonium nitrate-based mining explosives, such as ANFO, heavy ANFO and emulsion explosives, is lowered by adding an expanded grain, such as expanded popcorn, expanded rice, or expanded wheat, to the explosive. As much as 10% of the explosive composition may be an expanded grain. The present invention may be used with porous ammonium nitrate, dense agricultural grade ammonium nitrate, crystalline ammonium nitrate, and ground ammonium nitrate.

29 Claims, No Drawings

METHOD OF LOWERING THE DENSITY OF AMMONIUM NITRATE-BASED MINING EXPLOSIVES WITH EXPANDED AGRICULTURAL GRAIN SO THAT A DENSITY OF 0.3G/CC TO 1.0G/CC IS ACHIEVED

This application is a file wrapper continuation of U.S. application Ser. No. 08/042,132, filed Apr. 2, 1993, now abandoned, for METHOD OF LOWERING THE DENSITY OF AMMONIUM NITRATE-BASED MINING EXPLOSIVES.

BACKGROUND OF THE INVENTION

1. Field of the Invention

This invention relates to ammonium nitrate-based mining explosives. More particularly, the present invention relates methods for lowering the density of ammonium nitrate-based mining explosives such as ANFO, heavy ANFO, and emulsion explosives.

2. Technology Review

The most widely used mining explosive is the combination of ammonium nitrate prills (AN) and fuel oil (FO), commonly referred to in the trade as "ANFO". A simple mixture of AN and FO in the ratio of 94:6 (AN:FO) results in an explosive having a nearly perfect oxygen balance. ANFO is low in cost and easily manufactured. Moreover, ANFO is used by simply pouring it into a borehole for detonation below ground.

One problem with ANFO is that it has a low bulk strength (i.e., blasting energy per unit of volume) for certain blasting applications. As a result, to obtain the necessary blasting energy from ANFO it may be necessary to drill boreholes closer together, thereby increasing the drilling costs. In addition, ANFO has a narrow density range, typically from about 0.80 gm/cc to about 0.85 gm/cc, depending on the prill density and percent fines.

Another problem with ANFO is its low water resistance caused by high solubility of ammonium nitrate in water. As the ammonium nitrate content of the explosive mixture is reduced by dissolution, the efficiency of the explosive charge is correspondingly reduced.

It is well known that boreholes commonly contain water, especially when mining is conducted below the water in the surrounding rock. Water resistant ANFO explosives have been developed for use in wet boreholes. A commonly used water resistant ANFO is simply ANFO or ammonium nitrate prills coated with a water-in-oil emulsion. An emulsion with ANFO is known as heavy ANFO in the trade. The emulsion may consist of a simple concentrated, preferably saturated aqueous solution of one or more oxidizer salts (ammonium nitrate, sodium nitrate, calcium nitrate, etc.) as the disperse phase and oil plus an emulsifying agent as the continuous phase.

Generally, as the amount of emulsion added to the ANFO increases, the water resistance of the explosive composition increases. Also, as the amount of emulsion added to ANFO increases, the density of the explosive composition increases. The following chart illustrates how adding emulsion to ANFO increases the density and water resistance of the resulting heavy ANFO:

| % Emulsion in ANFO | Density (gm/cc) | Water Resistance* |
|---|---|---|
| 0 | 0.82 | 0 |

-continued

| % Emulsion in ANFO | Density (gm/cc) | Water Resistance* |
|---|---|---|
| 20 | 1.07 | 0 |
| 25 | 1.15 | 1 |
| 30 | 1.21 | 2 |
| 35 | 1.26 | 3 |
| 40 | 1.31 | 4 |
| 45 | 1.36 | 4 |

*Water resistance scale 0 to 5. 0 equals no water resistance. 1 and 2 equal water resistance sufficient for dewatered boreholes when loaded and shot. 3 and 4 equal water resistance sufficient for dewatered boreholes. 5 equals excellent water resistance (obtained with 50% or more emulsion).

Those skilled in the art will appreciate that water resistance and density are interrelated. Choosing either the density or water resistance determines to a large extent the other. Under normal circumstances it is not possible to have both high water resistance and low density with heavy ANFO. Those skilled in the art lack effective independent control of density and water resistance when using ANFO or heavy ANFO.

There are several important explosive applications where density control is important. For instance, when the rock is weak or soft, high density explosives provide more explosive power than is necessary, so that some of the blast energy is wasted. A lower cost, low density explosive charge would be preferable.

In final limits blasting, commonly used in open pit mining where a rock wall is left stable, it is important to control the amount of final blast into the rock wall. The explosive charge in final limits blasting is often less than the usual charge. To be most effective, the charge weight per borehole is preferably spread over the length of the borehole. It would be advantageous to control the explosive charge density such that the charge can be distributed throughout the borehole column.

When presplitting is used, decoupling the presplitting cartridges can be avoided by using low density explosive charges. Also, when blasting near urban areas or close to structures which could be damaged, the explosive charge weight is usually limited. As in final limits blasting, the charge weight should be spread throughout the borehole to be most effective. Thus, control of the explosive charge density is important.

Most AN used in ANFO is low density porous AN prill which absorbs FO and provides a rapid explosion. Low cost agricultural grade AN is dense and reacts more slowly than porous AN, i.e., its energy is delivered over a longer time period. In some blasting applications a heaving effect, caused by a slow explosion, is preferred over a shattering effect, caused by a rapid explosion. It would be advantageous to be able to independently control the density of ANFO prepared from dense agricultural grade AN such that it can be used in a wide variety of applications.

Explosive additives for modifying density are known in the art. For example, wood meal, saw dust, bagasse, peanut and oat husks, and peanut shells lower the density of ANFO explosives. Although these agricultural waste products have a density lower than ANFO, their density is still relatively high; for instance, saw dust has a density of about 0.6 gm/cc. Thus, to lower the density of 1.3 gm/cc heavy ANFO to a desired density of 0.85 gm/cc (about that of normal ANFO), it would be necessary to add more than 20% saw dust to the explosive, an amount which is so high that the explosive would likely be ineffective.

Those skilled in the art will appreciate that such additives not only affect density, but also affect explosive performance. For example, styrofoam (expanded polystyrene) has been used to modify density of ANFO explosives. Styrofoam is a fuel which requires 16 parts oxidizer for every 1 part polystyrene. If there is insufficient oxidizer, the explosive is fuel rich and may generate toxic or hazardous gasses from incomplete combustion. If fuel oil is replaced by styrofoam, then the maximum amount of styrofoam which may be included in an explosive and still maintain oxygen balance is about 5.9% styrofoam. In addition, removal of all the fuel oil from AN prill reduces the sensitivity of the explosive. Furthermore, styrofoam is costly (about $1/lb.) compared to the cost of ANFO (about $0.10/lb.).

Thus, it will be appreciated that styrofoam has limited usefulness as a density modifying additive in explosive compositions because at high usage it disrupts the stoichiometric oxygen balance and because of its high cost.

Certain techniques for sensitizing heavy ANFO and emulsion explosives also affect density and could be used for density control. For example, expanded perlite and glass microballoons are often added to these formulations to create "hot spots" which sensitize the explosive, but they also reduce the explosive density. They are cost effective sensitizers, but expensive density reducing agents.

Chemical gassing techniques have also been used to sensitize fluid heavy ANFO formulations. Sodium nitrite and hydrogen peroxide are two commonly used gassing agents which also reduce the density of emulsions and high emulsion containing ANFO blasting agents. These gassing agents can form foams with densities as low as about 0.5 gm/cc; however, as the density becomes lower, the foam becomes unstable. Hence, it is difficult and usually impractical to control density over a wide range using chemical gassing agents.

It will be appreciated that there is a need in the art for methods of independently lowering the density of ammonium nitrate-based explosives while retaining desired water resistance and explosive performance.

Such methods of lowering the density of ammonium nitrate-based explosives are disclosed and claimed herein.

SUMMARY OF THE INVENTION

The present invention relates to methods for lowering the density of ammonium nitrate-based mining explosives such as ANFO, heavy ANFO, and emulsion explosives. The method includes adding an expanded grain, such as expanded popcorn, expanded rice, or expanded wheat, to an ammonium nitrate-based explosive. A typical ANFO explosive composition within the scope of the present invention includes ammonium nitrate prills, fuel oil, and an expanded grain for reducing the density of the explosive composition. As much as 10% by weight of the explosive composition may be an expanded grain. The present invention may be used with porous ammonium nitrate prills, dense agricultural grade ammonium nitrate prills, and other types of particulate solid ammonium nitrate. Other oxidizers such as calcium nitrate and sodium nitrate may partially replace some of the ammonium nitrate oxidizer.

Expanded grains are also added in heavy ANFO to reduce the density. Thus, the explosive compositions of the present invention may also include an emulsion, typically prepared from an emulsifier, fuel oil, and an aqueous solution phase. The aqueous solution phase of the emulsion usually includes from about 50% to 85% by weight ammonium nitrate, from about 0% to 40% by weight calcium nitrate, from about 0% to 15% by weight sodium nitrate, and from about 15% to 25% by weight water. The emulsion typically contains from about 5% to 12% by weight fuel oil. All percentages expressed herein are expressed as weight percentages.

DETAILED DESCRIPTION OF THE INVENTION

According to the present invention, an expanded grain, such as expanded popcorn, expanded rice, or expanded wheat, is added to ammonium nitrate-based mining explosives, such as ANFO, heavy ANFO, and emulsion explosives, to lower the explosive's density. As much as 10% by weight of the explosive composition may be an expanded grain.

The ammonium nitrate-based explosives used herein include conventional ANFO made from ammonium nitrate prills (AN) and fuel oil (FO), typically mixed at a ratio of 94:6 (AN:FO). Fuel oil or diesel oil is commonly used, but other oils, of mineral or other origin may be substituted for or combined with the fuel oil. The present invention may be used with both porous ammonium nitrate prills and dense agricultural grade ammonium nitrate prills. Crystalline and/or ground ammonium nitrate may also be used. Other oxidizers such as calcium nitrate and sodium nitrate may partially replace some of the ammonium nitrate oxidizer.

Heavy ANFO, ANFO with an emulsion to impart water resistance, is also used in connection with the present invention. Emulsion explosives, sensitized by voids or bubbles, are also used with the present invention. Typical emulsions used in heavy ANFO and emulsion explosives consist of a concentrated aqueous solution of one or more oxidizer salts (ammonium nitrate, sodium nitrate, calcium nitrate, etc.) as the disperse phase and oil plus an emulsifying agent as the continuous phase. The aqueous solution phase of the emulsion usually includes from about 50% to 85% by weight ammonium nitrate, from about 0% to 40% by weight calcium nitrate, from about 0% to 15% by weight sodium nitrate, and from about 15% to 25% by weight water. The emulsion typically contains from about 5% to 12% by weight fuel oil.

The emulsifier may be selected from many that are available. Emulsifiers are often esters or other derivatives of monohydric or polyhydric alcohols, combined with long chain components or other lyophilic materials. The emulsifier is usually blended with the fuel oil before the aqueous solution is added. Once formed, the emulsion is then blended with ANFO or with oil deficient AN to form heavy ANFO.

Expanded grains may be added to dry ANFO, wet and dry heavy ANFO, and to emulsion explosives to effectively reduce the density. Although one might expect water or an emulsion to make expanded grains soggy, surprisingly it has been found that the emulsion used in heavy ANFO and emulsion explosives does not detrimentally affect the density reducing function of expanded grains. In addition, expanded grains have remained effective at reducing density even after adding 10% by weight water to the explosive.

The foregoing observation has an added benefit when dry materials are used in the explosive composition. In some cases segregation of dry materials is observed due to different particle densities. Adding a small amount of water slows down segregation by making the explosive composition sticky. Similarly, a small amount of emulsion can be added to stop segregation. If it is necessary to add water or emulsion to stop segregation, one can offset the density increase by adding a little more expanded grain.

Being carbohydrates, expanded grains are not good fuels and they do not significantly alter the oxygen balance of the explosive composition in the small amounts required for density reduction. For example, one part expanded popcorn requires only six parts oxidizer for combustion. Since expanded popcorn has an extremely low density, adding just 1% by weight expanded popcorn to ANFO or heavy ANFO has been shown to reduce its density between 15% and 24%.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

Example 1

Several heavy ANFO explosive compositions were prepared by combining an emulsion with porous ammonium nitrate prills. The emulsion was prepared from an ammonium nitrate/calcium nitrate oxidizer solution, fuel oil, and emulsifier. Expanded popcorn, expanded wheat, and expanded rice were added to the explosive compositions, and the density was measured. The results are reported below in Table 1.

TABLE 1

| Percent Emulsion | Explosive Composition Density (gm/cc) Weight % Expanded Grain | | | | | | |
|---|---|---|---|---|---|---|---|
| | Popcorn | | | | | Wheat | Rice |
| | 0% | 1% | 24 | 4% | 8% | 2% | 2% |
| 0 | 0.83 | 0.70 | 0.63 | 0.53 | 0.39 | 0.69 | 0.74 |
| 10 | 0.86 | 0.69 | 0.60 | 0.52 | 0.31 | 0.68 | 0.64 |
| 20 | 0.96 | 0.73 | 0.65 | 0.59 | 0.28 | 0.75 | 0.71 |
| 30 | 1.16 | 0.89 | 0.66 | 0.64 | 0.27 | 0.79 | 0.84 |
| 40 | 1.31 | 1.04 | 0.76 | 0.60 | 0.29 | 0.97 | 0.99 |
| 50 | 1.31 | 1.17 | 0.83 | 0.76 | 0.37 | 1.12 | 1.12 |
| 70 | 1.33 | 1.18 | 0.99 | 0.86 | 0.29 | 1.13 | 1.10 |

TABLE 1-continued

| Percent Emulsion | Explosive Composition Density (gm/cc) Weight % Expanded Grain | | | | | | |
|---|---|---|---|---|---|---|---|
| | Popcorn | | | | | Wheat | Rice |
| | 0% | 1% | 24 | 4% | 8% | 2% | 2% |
| 100 | 1.36 | 1.13 | 0.98 | 0.88 | 0.49 | 1.11 | 1.11 |

The foregoing results suggest that small amounts of expanded grains can be added to ANFO, heavy ANFO, and emulsion explosives to dramatically reduce the density.

Example 2

Several different explosive compositions were prepared in the field and measured for density. Either 2% or 4% expanded popcorn by weight was then added to the explosives and the density was measured again. The explosives were placed in cardboard tubes (test conditions) and detonated. The results are shown below in Table 2.

TABLE 2

| | Mix # | | | | | | | | |
|---|---|---|---|---|---|---|---|---|---|
| | 1 | 2 | 3 | 4 | 5 | 6 | 7 | 8 | 9 |
| Mass % | | | | | | | | | |
| Emulsion | 98 | 98 | 50 | 50 | 50 | — | — | — | 20 |
| AN | — | — | 50 | 50 | 50 | 94 | 94 | 94 | 77[a] |
| Fuel Oil | — | — | — | — | — | 6 | 6 | 6 | — |
| Microballoons | 2 | 2 | — | — | — | — | — | — | — |
| Other | | | | | | | | 10[b] | 2[c] |
| Density (gm/cc) | 1.15 | 1.15 | 1.34 | 1.34 | 1.34 | 0.83 | 0.83 | 0.83 | 1.18 |
| Lbs Exp. Popcorn per 100 lbs | 2 | 4 | 2 | 4 | 8 | 1 | 2 | 4 | 2 |
| Density | 1.03 | 0.83 | 0.93 | 0.69 | 0.50 | 0.74 | 0.61 | 0.65 | 0.85 |
| Charge Diameter (inch) | 6 | 6 | 6 | 6 | 6 | 6 | 6 | 6 | 8 |
| Primer[d], lbs. | 1 | 1 | 1 | 1 | 1 | 1 | 1 | 1 | 2 |
| Result[e] | D | D | D | D | D | D | D | D | D |

[a]Dense AN prill (agricultural grade).
[b]Added 10% water to ANFO/Popcorn blend. The blend remained dry, and segregation decreased.
[c]Solid carbonaceous fuel, 2%.
[d]Pentolite primer used.
[e]D = Detonate.

The foregoing range tests suggest that an expanded grain, such as expanded popcorn, can be added to various explosive compositions in the field to lower their density without hindering successful detonation of the explosive. It should be noted that the actual density reduction observed in the field is slightly less than that observed in the laboratory, apparently because the expanded popcorn becomes damaged or broken.

From the foregoing it will be appreciated that the present invention provides low density explosive compositions based on ANFO, heavy ANFO, and emulsion explosives. The present invention also provides methods for independently lowering the density of ammonium nitrate-based explosives while retaining desired water resistance and explosive performance.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An explosive composition comprising:

an ammonium nitrate-based mining explosive; and an expanded agricultural grain for reducing the density of the explosive composition, wherein the expanded grain is present in the explosive composition up to about 10% by weight sufficient to lower the density of the explosive composition to from about 0.3 g/cc to 1 g/cc.

2. An explosive composition as defined in claim 1, wherein the ammonium nitrate-based mining explosive is ANFO, said ANFO comprising ammonium nitrate and fuel oil.

3. An explosive composition as defined in claim 1, wherein the ammonium nitrate-based mining explosive is heavy ANFO.

4. An explosive composition as defined in claim 3, wherein the heavy ANFO comprises an emulsion and ammonium nitrate.

5. An explosive composition as defined in claim 3, wherein the heavy ANFO comprises an emulsion and ANFO.

6. An explosive composition as defined in claim 1, wherein the ammonium nitrate-based mining explosive is an emulsion explosive.

7. An explosive composition as defined in claim 1, wherein the expanded grain is expanded popcorn.

8. An explosive composition as defined in claim 1, wherein the expanded grain is expanded rice.

9. An explosive composition as defined in claim 1, wherein the expanded grain is expanded wheat.

10. An explosive composition as defined in claim 1, wherein the ammonium nitrate is porous ammonium nitrate.

11. An explosive composition as defined in claim 1, wherein the ammonium nitrate is dense agricultural grade ammonium nitrate.

12. An explosive composition as defined in claim 1, wherein the ammonium nitrate is ground ammonium nitrate.

13. An explosive composition as defined in claim 1, wherein the ammonium nitrate is crystalline ammonium nitrate.

14. An explosive composition as defined in claim 1, wherein the ammonium nitrate-based mining explosive further comprises calcium nitrate.

15. An explosive composition as defined in claim 1, wherein the ammonium nitrate-based mining explosive further comprises sodium nitrate.

16. An explosive composition as defined in claim 1, further comprising up to 10% water to prevent segregation of the dry explosive ingredients.

17. A method of lowering the density of an ammonium nitrate-based mining explosive composition comprising adding an expanded agricultural grain to the ammonium nitrate-based mining explosive composition, wherein the amount of expanded grain added to the explosive composition is up to 10% by weight of the explosive composition sufficient to lower the density of the explosive composition to from about 0.3 g/cc to 1 g/cc.

18. A method of lowering the density of an ammonium nitrate-based mining explosive as defined in claim 17, wherein the ammonium nitrate-based mining explosive is ANFO, said ANFO comprising ammonium nitrate and fuel oil.

19. A method of lowering the density of an ammonium nitrate-based mining explosive as defined in claim 17, wherein the ammonium nitrate-based mining explosive is heavy ANFO.

20. A method of lowering the density of an ammonium nitrate-based mining explosive as defined in claim 19, wherein the heavy ANFO comprises an emulsion and ammonium nitrate.

21. A method of lowering the density of an ammonium nitrate-based mining explosive as defined in claim 19, wherein the heavy ANFO comprises an emulsion and ANFO.

22. A method of lowering the density of an ammonium nitrate-based mining explosive as defined in claim 17, wherein the ammonium nitrate-based mining explosive is an emulsion explosive.

23. A method of lowering the density of an ammonium nitrate-based mining explosive as defined in claim 17, wherein the ammonium nitrate-based mining explosive further comprises calcium nitrate.

24. A method of lowering the density of an ammonium nitrate-based mining explosive as defined in claim 17, wherein the ammonium nitrate-based mining explosive further comprises sodium nitrate.

25. A method of lowering the density of an ammonium nitrate-based mining explosive as defined in claim 17, wherein the expanded grain added to the explosive composition is expanded popcorn.

26. A method of lowering the density of an ammonium nitrate-based mining explosive as defined in claim 17, wherein the expanded grain added to the explosive composition is expanded rice.

27. A method of lowering the density of an ammonium nitrate-based mining explosive as defined in claim 17, wherein the expanded grain added to the explosive composition is expanded wheat.

28. An explosive composition as defined in claim 1, wherein the expanded grain is present in the explosive composition in an amount sufficient to lower the density of the explosive composition to a value below about 0.85 g/cc.

29. A method of lowering the density of an ammonium nitrate-based mining explosive as defined in claim 17, wherein a sufficient amount of the expanded grain is added to the explosive composition to lower the density of the explosive composition to a value below about 0.85 g/cc.

* * * * *